US005579623A

United States Patent [19]

Stark et al.

[11] Patent Number: 5,579,623

[45] Date of Patent: Dec. 3, 1996

[54] PREFABRICATED REVEAL JOINT

[75] Inventors: Thomas S. Stark, Coral Springs, Fla.; Thomas J. Gretz, Clarks Summit, Pa.

[73] Assignee: Plastic Components, Inc., Miami, Fla.

[21] Appl. No.: 260,070

[22] Filed: Jun. 15, 1994

[51] Int. Cl.[6] ..... E04C 2/42

[52] U.S. Cl. ..... 52/665

[58] Field of Search ..... 52/665, 506.06, 52/506.07; 403/217, 218, 174, 178, 364

[56] References Cited

U.S. PATENT DOCUMENTS 3,398,497 8/1968 Hellmich et al. ..... 52/665

3,785,110 1/1974 Galloway et al. ..... 52/506.06

4,019,300 4/1977 Sauer et al. ..... 52/506.06

*Primary Examiner*—Carl D. Friedman

*Assistant Examiner*—Yvonne Horton-Richardson

[57] ABSTRACT

A prefabricated joint assembly molded of a single piece of plastic and used for connecting decorative channels or reveals on the exteriors of buildings. Reveals are typically used to form an aesthetically pleasing effect on the exterior surface of a building that will be covered with stucco, mortar, cement, plaster, drywall, or the like. This invention provides a relatively inexpensive joint that vastly simplifies the job of joining reveals at the construction site.

9 Claims, 4 Drawing Sheets

PREFABRICATED REVEAL JOINT

FIELD OF THE INVENTION

This invention relates to construction materials for walls of buildings, and in particular, to a prefabricated joint for connecting decorative channels or reveals. Reveals are typically used to form an aesthetically pleasing effect on the exterior surface of a building that will be covered with stucco, mortar, cement, plaster, drywall, or the like. This invention provides a relatively inexpensive and easy to use joint construction.

BACKGROUND OF THE INVENTION

The use of channels as reveals to form aesthetically pleasing looks on wall surfaces is well known. Presently, the reveals are constructed of typically aluminum or plastic materials such as polyvinyl chloride (PVC).

For aluminum reveals, prefabricated joints are presently accomplished by cutting the ends of each reveal which will be joined to a proper adjoining angle, abutting the cut ends, and welding the adjoined edges to form a joint.

For plastic or aluminum reveals, joints are presently prefabricated by mitering the reveal sections so that they will properly abut, placing the sections in proper abutting relationship, applying waterproofing such as adhesive tape to the back side of the abutting sections and applying glue or other similar adhesive or welding to obtain joint rigidity.

The disadvantage with the present art of prefabricated reveal joints is that they require precise mitered cuts, lack integral alignment of the reveals with the joint, and it is possible for the joint to have water leakage if the aluminum joints are not properly welded and sealed together or if the plastic joints are not properly taped and glued.

SUMMARY OF THE INVENTION

The object of the invention is to provide a prefabricated joint which is inexpensive to manufacture, easy to apply in the field, and of one piece molded construction to prevent water leakage from occurring at the joint.

The joint is typically injection molded of PVC or similar plastic and contains trackways that allow the flanges of the reveal base to slidingly enter the joint until the channel of the reveal properly abuts the channel of the joint. Several types of joints may be formed for accommodating the various juncture points for the reveals, such as cross-joints, T-joints, L-joints, butt-joints, inside corners, or outside corners. After being joined in the field, the PVC trackway of the prefabricated joint envelops the abutted ends of the channel of the reveal and the channel of the joint, allowing a water tight fit without the use of adhesive or caulking.

DESCRIPTION OF THE INVENTION

Figure 1:
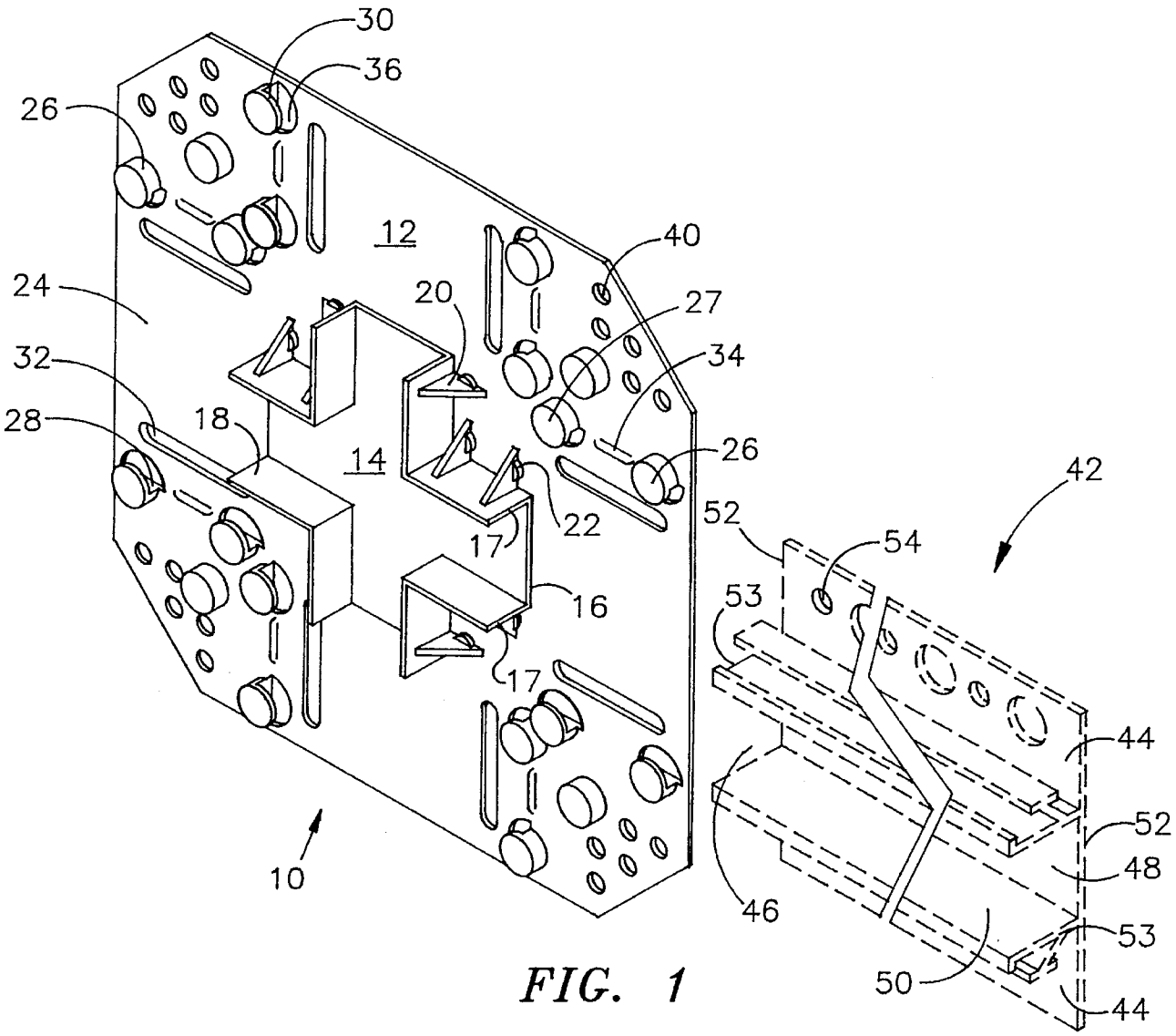
FIG. 1 is a perspective view of a cross-joint and a typical reveal in phantom lines as it would be lined up prior to slidingly engaging it in the trackway of the joint.

A prefabricated cross-joint 10 in accordance with the present invention is shown in FIG. 1. The cross-joint 10 is of one-piece molded construction and is typically formed of a plastic material such as PVC. The cross-joint 10 has walls 18 formed perpendicular to a base plate 12. Eight such walls 18 define a cross junction. Angular ribs 20 support the walls 18 and rib supports 22 stiffen the angular ribs 20 to keep the walls from flexing and in a proper perpendicular relationship to the base 12.

Four trackways are defined on the cross-joint 10 by the base plate 12 forming a track bottom surface 24 and a plurality of inner 27 and outer 26 guide buttons. Two outer guide buttons 26 and two inner guide buttons 27 define each trackway for the four reveals which will be joined at the cross-joint. Each guide button has a track guide surface 28 formed by the semi-circular cutout 36 in the guide button. An overhanging lip 30 which is formed by the cutout also serves to form the trackway and guide the reveal.

A reveal 42, also shown in FIG. 1, consists of a base plate 48 having outward extending flanges 44, a channel 46 defined by channel walls 50 perpendicular to the base plate 48. The end of the channel 46 is defined by edges 53 of the channel walls 50 and edge 52 of the base plate 48.

When applied in the field, the cross-joint 10 would typically be nailed or tied into place through one of the holes 40 in the base plate 12. Nails are typically used to fasten the cross-joint 10 to concrete substrates and wire is typically used to tie the cross-joint 10 to metal or plastic lathe substrates. A reveal would then typically be cut square to the correct length and one end inserted into the trackway defined by the track bottom surface 24 and the guide buttons with their semi-circular cutouts 36. The square cuts are the easiest to make and no miter or angle cuts are needed when the invention is used.

Reveal 42 is shown in FIG. 1 aligned in the proper position for insertion into a trackway. As reveal 42 is inserted, the base edge 52 of the reveal enters and is guided by the trackway formed by the track bottom surface 24 and the track guide surface 28 formed by the semi-circular cutout 36 in the outer guide buttons 26. The overhanging lip 30 acts to hold the reveal 42 against the track bottom surface 24. As the reveal 42 is advanced past the outer guide buttons 26 it is further held in the track by a ridge 34 positioned on base plate 12 between the outer and inner guide buttons. As the reveal 42 is advanced past the ridge 34 it is guided into proper position by the inner guide button 27 with semi-circular cutout 36, track guide surface 28, and overhanging lip 30 which further defines the trackway. At full insertion the leading edge 52 of the reveal base plate 48 abuts the base edge 16 of the intersection 14 and the reveal side wall edge 53 abuts the intersection side wall edge 17. The location of the guide buttons is such that the sliding fit of the reveal 42 is a tight fit so that when fully inserted, reveal 42 is held in place against base edge 16 and side wall edge 17 of intersection 14.

After all four reveals are inserted fully into the trackways of cross-joint 10 and are fixed in place, stucco or other similar filling material is spread on the exterior of the channel 46 of the reveal and the exterior of the intersection 14. The holes 40 in the base plate 12 of the cross-joint 10 and the holes 54 in the flanges of the reveal 42 are used for keying, or holding the stucco in place. As stucco is spread on the exterior of the channels and intersection, some stucco enters the holes that have not been filled with nails or similar fastening devices, thereby allowing the stucco to hold a firm grip on the area surrounding the channel. Slots 32 formed in the base plate 12 of cross-joint 10 line up with the holes 54 in the inserted reveals, allowing stucco to flow through the holes 54 in the reveal 42 and also through the slot 32 giving better adhesion of the stucco at the juncture of the reveals and intersection.

In its finished state, the channel and the interior of the intersection would be visible and the area surrounding it would contain an even layer of stucco or other similar materials such as mortar, cement, plaster, or drywall. The channel and interior of the intersection may be painted a contrasting color if desired.

Figure 2:
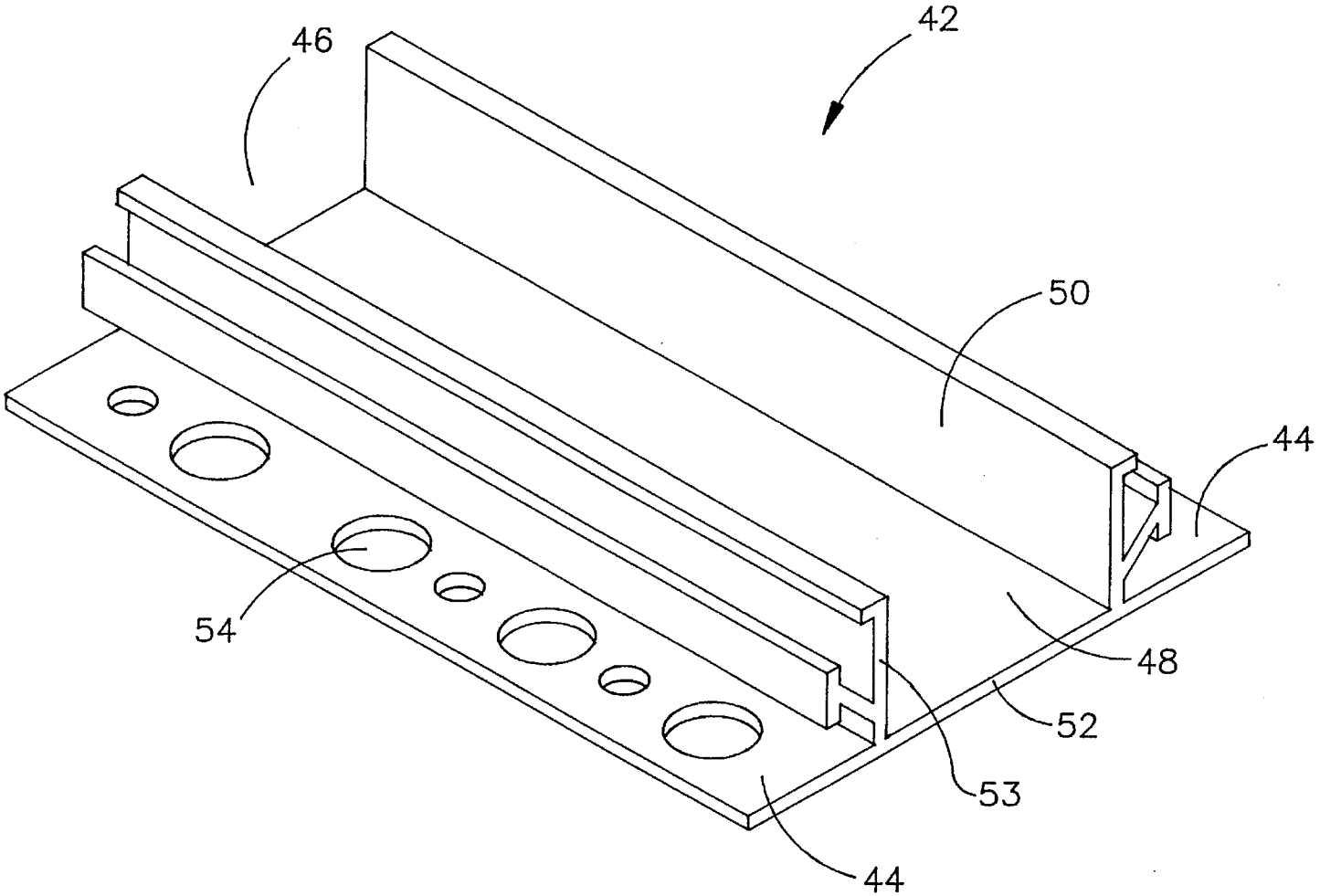
FIG. 2 is a perspective view of a portion of a reveal.

FIG. 2 is a perspective view of a reveal 42 showing the channel 46 formed by the reveal base plate 48 and channel walls 50. The reveal base edge 52 and channel wall edge 53 are depicted as are the reveal flanges 44 and holes 54 in the flanges.

Figure 3:
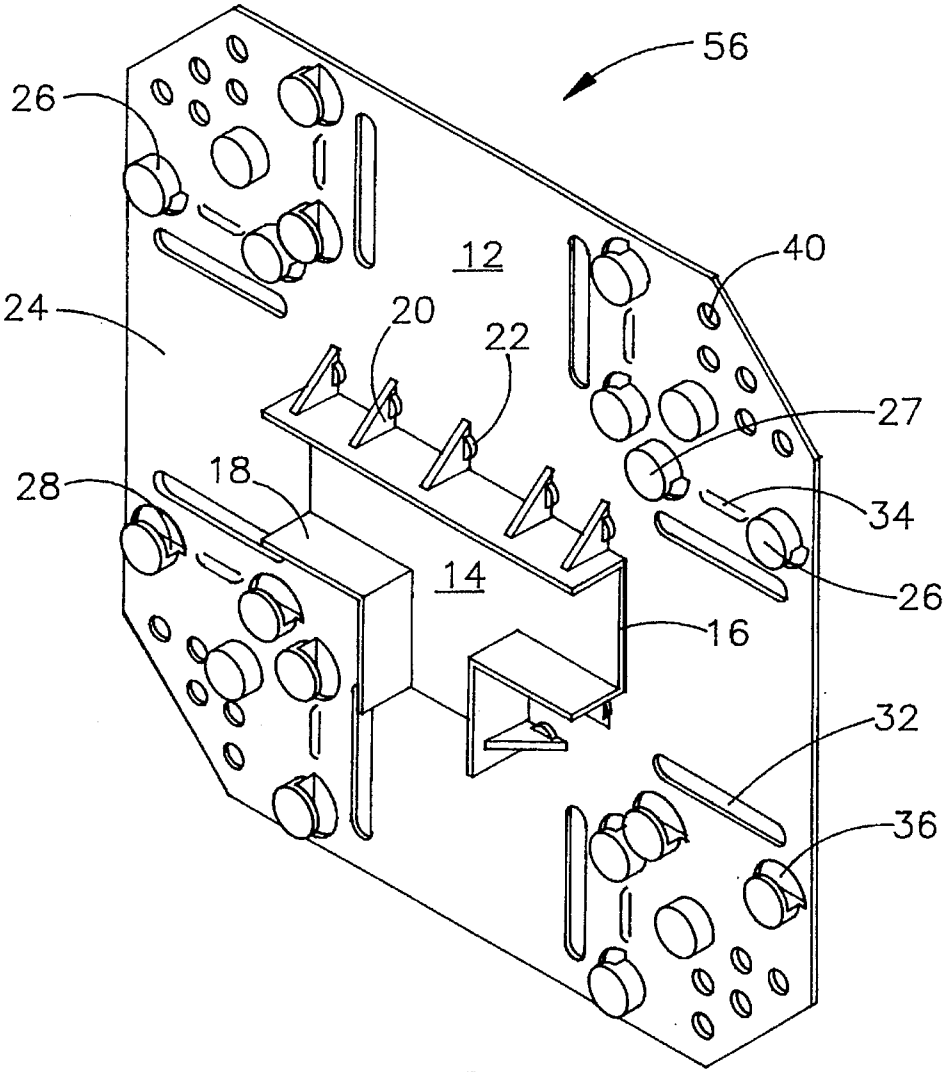
FIG. 3 is a perspective view of another embodiment of the present invention, a T-joint.

FIG. 3 is a perspective view of another embodiment of the present invention, a T-joint 56. The T-joint 56 is similar to the cross-joint of FIG. 1 except only three trackways instead of four are used for the insertion of reveals. Three reveals will be inserted in the three trackways to form a "T" joint defined by five walls 18 extending from the base plate 12. All other numbered parts in FIG. 3 are analogous to the same parts shown in FIG. 1.

Figure 4:
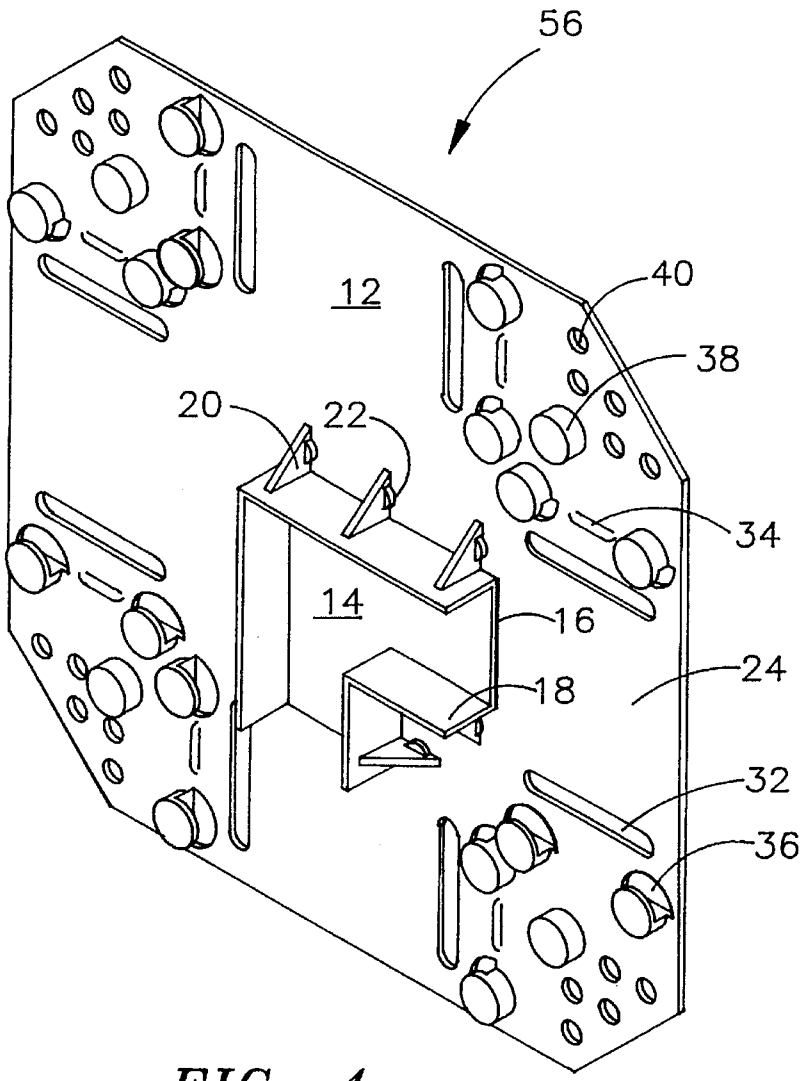
FIG. 4 is a perspective view of another embodiment of the present invention, an L-joint.

FIG. 4 is a perspective view of another embodiment of the present invention, an L-joint 58. The L-joint 58 is similar to the cross-joint of FIG. 1 and the T-joint of FIG. 2 except only two trackways are used for the insertion of reveals. Two reveals will be inserted in the two trackways to form an "L" joint defined by four walls 18 extending from the base plate 12. All other numbered parts in FIG. 4 are analogous to the same parts shown in FIGS. 1 and 3.

Similarly, a butt-joint, inside corner and outside corner may be provided utilizing the concepts of the invention.

The invention provides one-piece precision joints that enables field placement of screed channels or reveals with only simple square cuts at watertight intersections.

Having thus described the invention with reference to several embodiments, it is to be understood that the invention is not so limited by the description herein but is defined as follows by the appended claims.

What is claimed is:

1. A one piece joint assembly, comprising:

a base plate;

a raised portion having an outer periphery integral with said base plate and walls integral with and extending from the outer periphery of said raised portion perpendicular to said base plate and defining a mating abutting channel for receiving a reveal; and guide members integral with and extending from said base plate to provide for the insertion and guidance of a reveal until it abuts with said mating abutting channel.

2. The joint assembly of claim 1, wherein said guide members are guide buttons which contain a groove having a face and an overhanging lip defined by said groove, said groove being formed along one side of said guide button to help define a trackway for insertion of a reveal.

3. The joint assembly of claim 2, comprising both innermost and outermost guide buttons and guide ridges between said innermost and said outermost guide buttons, said guide ridges further guiding insertion of said reveal in said trackway as said reveal is inserted past said outermost guide buttons.

4. The joint assembly of claim 1 wherein said mating abutting channel is an intersection of a plurality of channels forming a cross shape for accommodating the joining of four reveal ends.

5. The joint assembly of claim 1 wherein said mating abutting channel is an intersection of a plurality of channels forming a "T" shape for accommodating the joining of three reveal ends.

6. The joint assembly of claim 1 wherein said mating abutting channel is an intersection of a plurality of channels forming an "L" shape for accommodating the joining of two reveal ends.

7. A method of forming a decorative reveal grid pattern comprising the steps of:

providing a plurality of one-piece joint assemblies each having trackways defined by guide members;

creating a grid starting point by fixing a one-piece joint assembly in place;

cutting reveals to length from indeterminate lengths using a square cut;

inserting the end of said square cut reveal into each trackway leading into said one-piece joint assembly;

fixing said reveals in place;

continuing the process of joining one-piece joint assemblies and reveals until a grid pattern is completed on the wall of a structure; and spreading stucco, cement, plaster, mortar, drywall or the like exteriorly of said channels formed by said reveals and said one-piece joint assemblies until an even surface is obtained that is interrupted only by the open channels of the reveals and joint assemblies.

8. The method of claim 7 wherein said one-piece joint assemblies comprise:

a base plate;

a raised portion having an outer periphery integral with said base plate and walls integral with and extending from the outer periphery of said raised portion perpendicular to said base plate and defining a mating abutting channel for receiving a reveal; and guide members integral with and extending from said base plate to provide for the insertion and guidance of a reveal until it abuts with said mating abutting channel.

9. A complete joint comprising:

a one-piece joint assembly affixed in place and having a base plate, a raised portion having an outer periphery integral with said base plate, walls integral with and extending from the outer periphery of said raised portion perpendicular to said base plate and defining a mating abutting channel for receiving a reveal, and guide members integral with and extending from said base plate to provide for the insertion and guidance of a reveal until it abuts with said mating abutting channel;

one or more reveals having square cut ends affixed in place with said square cut ends of said reveals inserted fully into said one-piece joint assembly and having holes in flanges of said reveals lining up with slots in said base plate of said one-piece joint assembly; and plaster, stucco, mortar, cement or similar paste applied over said one-piece joint assembly and outside of channels of said reveals, said paste flowing through said flanges of said reveals and said slots lined up with said holes in said reveals, thereby keying or holding said one-piece joint assembly and said reveals firmly in place.

* * * * *